US008246128B2

(12) United States Patent
Hauer

(10) Patent No.: US 8,246,128 B2
(45) Date of Patent: Aug. 21, 2012

(54) TRIGGER SENSOR FOR A FURNITURE DRIVE

(75) Inventor: Christian Hauer, Hörbranz (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/173,201

(22) Filed: Jun. 30, 2011

(65) Prior Publication Data

US 2011/0254418 A1 Oct. 20, 2011

Related U.S. Application Data

(63) Continuation of application No. PCT/AU2009/000458, filed on Nov. 25, 2009.

(30) Foreign Application Priority Data

Jan. 16, 2009 (AT) ..... 70/2009

(51) Int. Cl.
*A47B 88/00* (2006.01)

(52) U.S. Cl. ..... 312/319.5; 312/330.1

(58) Field of Classification Search ..... 312/330.1, 312/319.5–319.8; 318/646, 532, 640
See application file for complete search history.

(56) References Cited

U.S. PATENT DOCUMENTS

| | | | | |
|---|---|---|---|---|
| 3,005,672 | A * | 10/1961 | Becker | 312/319.7 |
| 4,232,227 | A * | 11/1980 | Finkenzeller et al. | 378/177 |
| 4,934,767 | A * | 6/1990 | Hoyt et al. | 312/330.1 |
| 6,510,051 | B2 * | 1/2003 | Kim | 361/679.43 |
| 7,159,957 | B2 * | 1/2007 | Huber et al. | 312/331 |
| 7,331,643 | B2 * | 2/2008 | Huber et al. | 312/319.5 |
| 7,414,225 | B2 * | 8/2008 | Yoshidome et al. | 219/392 |
| 7,500,400 | B1 * | 3/2009 | Huber | 73/795 |
| 7,645,002 | B2 * | 1/2010 | Fitz | 312/215 |
| 7,688,015 | B2 * | 3/2010 | Wenzel et al. | 318/466 |
| 2004/0100169 | A1 * | 5/2004 | Huber et al. | 312/319.5 |
| 2006/0061245 | A1 | 3/2006 | Huber et al. | |
| 2006/0261775 | A1 * | 11/2006 | Huber et al. | 318/646 |
| 2007/0080166 | A1 * | 4/2007 | Alford et al. | 221/257 |
| 2007/0180654 | A1 * | 8/2007 | Gasser | 16/242 |
| 2008/0115417 | A1 * | 5/2008 | Huber | 49/349 |
| 2008/0313663 | A1 * | 12/2008 | Oshida et al. | 720/615 |
| 2009/0284114 | A1 | 11/2009 | Fitz | |

(Continued)

FOREIGN PATENT DOCUMENTS

AT 413 472 3/2006

(Continued)

OTHER PUBLICATIONS

International Search Report issued Mar. 19, 2010 in International (PCT) Application No. PCT/AT2009/000458.

(Continued)

*Primary Examiner* — Janet M Wilkens
(74) *Attorney, Agent, or Firm* — Wenderoth, Lind & Ponack, L.L.P.

(57) ABSTRACT

A trigger sensor can trigger an electric furniture drive depending on a movement of the furniture part to be driven by the furniture drive caused by a user. The trigger sensor includes at least one actuator which can be moved by the furniture part into an assembly position, and the trigger sensor can capture movements of the furniture part along at least two directions which are orthogonal to each other. The trigger sensor has at least one actuator which captures each of the at least two directions.

21 Claims, 10 Drawing Sheets

U.S. PATENT DOCUMENTS

| | | | | |
|---|---|---|---|---|
| 2010/0084954 | A1* | 4/2010 | Schneider et al. | 312/319.1 |
| 2010/0168920 | A1* | 7/2010 | Hooker et al. | 700/275 |
| 2010/0212693 | A1* | 8/2010 | Johansson | 134/18 |

FOREIGN PATENT DOCUMENTS

| | | |
|---|---|---|
| DE | 10 2006 008 505 | 8/2007 |
| EP | 1 374 732 | 1/2004 |
| WO | 2004/100718 | 11/2004 |
| WO | 2006/017864 | 2/2006 |
| WO | 2006/113947 | 11/2006 |
| WO | 2007/122068 | * 11/2007 |
| WO | 2008/098266 | 8/2008 |

OTHER PUBLICATIONS

Austrian Patent Office Search Report dated Sep. 18, 2009 in Austrian Patent Application No. A 70/2009.

* cited by examiner

TRIGGER SENSOR FOR A FURNITURE DRIVE

This application is a Continuation of International application No. PCT/AT2009/000458, filed Nov. 25, 2009, the entire disclosure of which is incorporated herein by reference.

BACKGROUND OF THE INVENTION

The present invention concerns a trigger sensor for triggering an electric furniture drive based on a movement caused by a user of the furniture part to be driven by the furniture drive. The trigger sensor has at least one actuating member movable in the mounted position by the furniture part.

Trigger sensors are shown in various different design configurations in AT 413 472 B. Thus, for example, FIG. 17 shows a trigger sensor having a potentiometer actutable by an actuating member, the actuating member being integrated in the ejection lever of the furniture drive. For that purpose, the ejection lever is of a two-part configuration, the two lever parts being prestressed relative to each other by a spring.

FIG. 18 shows another embodiment in which the trigger sensor is fixed separately from the furniture drive to the furniture carcass. Here the actuating member of the trigger sensor is in the form of a spring-loaded push rod cooperating by way of a rack with a pinion of a potentiometer. The precise structure of that trigger sensor is shown in FIG. 19.

The above-discussed trigger sensors suffer from the disadvantage that they are each sensitive only to movements of the furniture part in a single predetermined direction. That direction is the specific direction in which the furniture part is movably mounted. If the furniture part is especially in the form of a drawer, the problem arises precisely in relation to very wide drawers which are of a small internal depth, that a trigger sensor which is sensitive only to the predetermined direction of movement of the furniture part does not permit reliable triggering of the furniture drive, particularly when the situation involves the manual application of pressure to the front panel of the drawer in one of the edge regions. In that case, more specifically, only a negligible depthwise movement of the furniture part parallel to the side walls of the furniture carcass is made possible by the force applied from the exterior by the user. Instead, that primarily involves a rotary movement of the furniture part, and that movement cannot be detected by the trigger sensor. That problem can also arise in relation to other furniture parts such as, for example, furniture doors or furniture flaps.

DE 10 2006 008 505 A1 discloses a trigger sensor having the features of the classifying portion of the present invention.

SUMMARY OF THE INVENTION

The object of the invention is to ensure reliable triggering of a furniture drive even in the above-discussed situations, wherein the invention seeks to provide that the trigger sensor has a simpler and less expensive structure than DE 10 2006 008 505 A1.

That object is attained by a trigger sensor having the features of the present invention, and an article of furniture having the features of the present invention.

The use of a trigger sensor which in itself is suitable for detecting movements of the furniture part along at least two directions which are mutually orthogonal makes it possible to ensure triggering of the furniture drive even when using a single trigger sensor without the use of complicated and expensive multi-axis acceleration sensors.

For the specific situation where the movable furniture part is a drawer which is mounted in a furniture carcass in such a way that it can be extended, it may even be sufficient under some circumstances if it is only provided that a movement of the furniture drive is monitored in a direction orthogonal to the extension direction. That can be effected for example in such a way that a trigger sensor, in accordance with the above-described state of the art, is either arranged at a side wall of the furniture carcass or is arranged at the rear side of the furniture carcass, and in that case cooperates with an abutment which extends in the extension direction and which is arranged on the furniture part.

The measures according to the invention are suitable in particular for use in relation to all electrically driven furniture parts in which there is either a storage space for filling items which can be introduced thereinto or removed therefrom (for example drawers) or which openably close such a storage space (for example flaps, doors).

Further advantageous embodiments are defined in the respective appendant claims.

A particularly simple configuration of the actuating member is afforded if it is provided that the actuating member is in the form of an articulated lever having two articulation arms movable relative to each other. In itself, it may be sufficient if the two articulation arms are mounted limitedly movably to each other for example by a flexural joint. Particularly preferably, however, it is provided that the articulation arms are connected together by a rotary joint.

In each of the described embodiments it can be provided that the actuating member cooperates with a potentiometer by way of an output drive. It will be appreciated that triggering can also be effected in a different manner than by a potentiometer. Other examples are the use of optical or magnetic encoders which can also be coupled to the output drive.

It can be provided in each embodiment that the furniture drive has a control or regulating device which is in signal relationship with the at least one trigger sensor. The control or regulating device can have a drive module which serves to control or regulate the electric drive unit. The electric drive unit can be for example in the form of an electric motor.

Other examples of movable furniture parts, besides drawers, are also furniture flaps and furniture doors.

BRIEF DESCRIPTION OF THE DRAWINGS

Further advantages and details of the invention will be apparent from the specific description and the accompanying Figures in which.

DETAILED DESCRIPTION OF THE INVENTION

Figure 1:
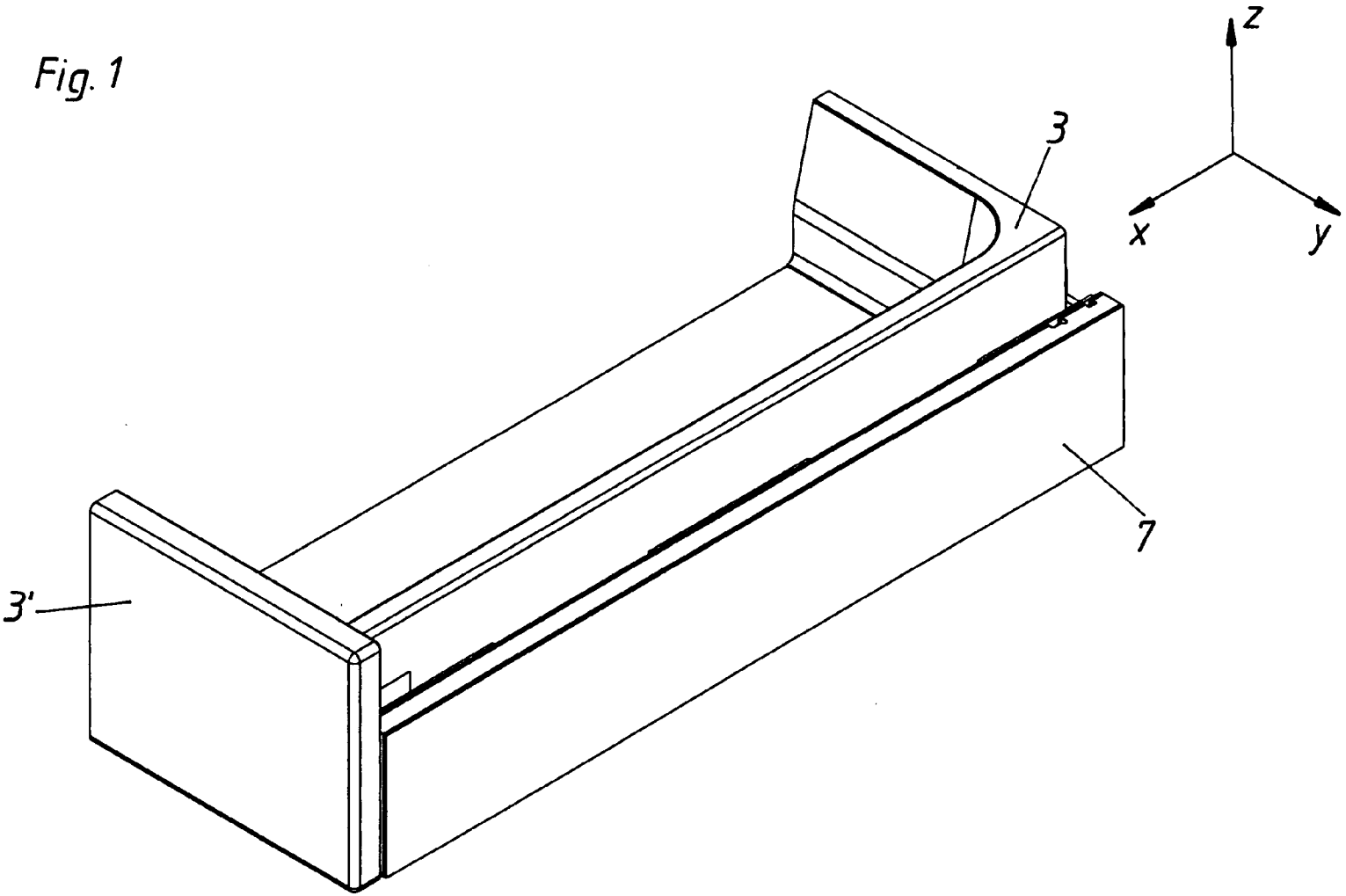
FIG. 1 is a perspective view showing a portion of the rear side of a furniture carcass with a furniture part mounted movably therein.

FIG. 1 is a partial view showing the front side and a side wall of a movable furniture part 3 in the form of a drawer, having a front panel 3'. The furniture part 3 is mounted in a furniture carcass 7 of which also only a part is shown, in such a way that it can be pushed in and pulled out. The coordinate system used hereinafter is represented in the form of a three-legged arrow. That direction along which the movable furniture part 3 is mounted in such a way that it can be pulled in and out is referred to as the x-direction. The y-direction extends parallel to the rear side to the furniture carcass 7. The z-direction extends at a right angle to those two directions, that is to say along the heightwise extent of the furniture carcass 7.

As already stated, it was only possible to detect movements along the x-direction with the previous trigger sensors. The invention makes it possible also to detect such movements of the furniture part 3, which have components greater than zero (i.e., at least some movement) along at least two of the orthogonal directions x, y, z.

Figure 2A:
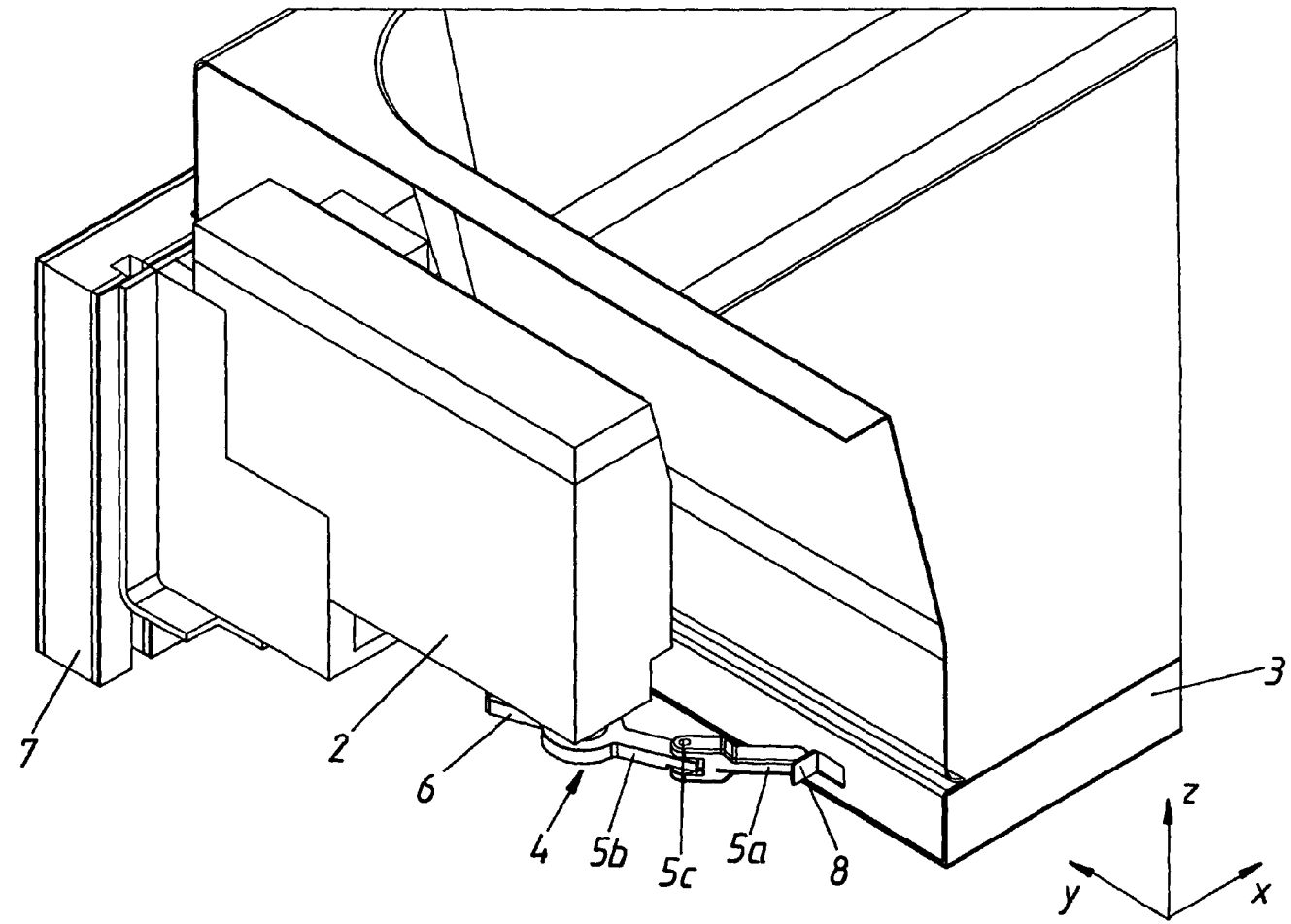
FIGS. 2*a*, 2*b*, 2*c* show a first embodiment of a trigger sensor according to the invention.
Figure 2B:
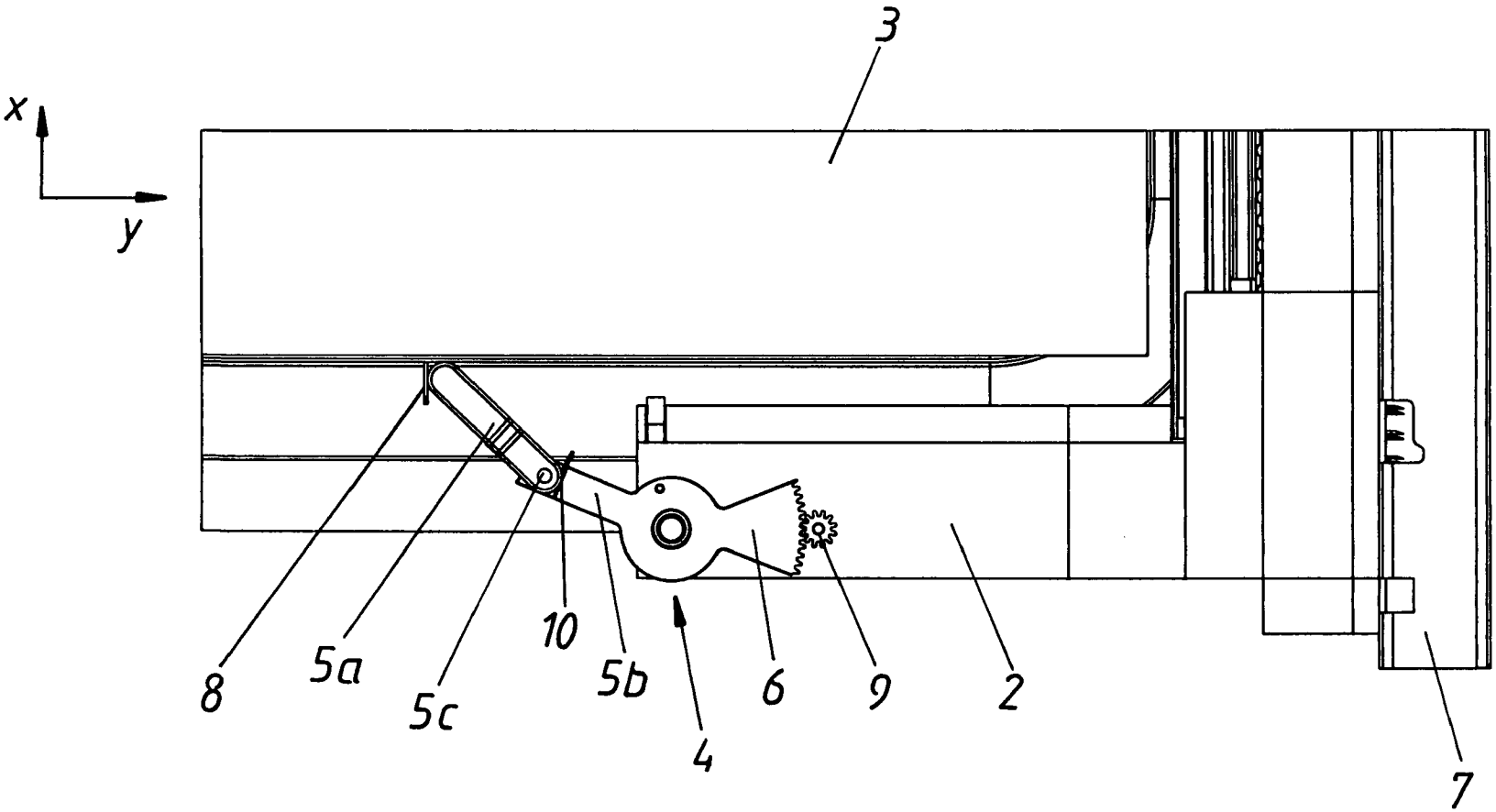
Figure 2C:
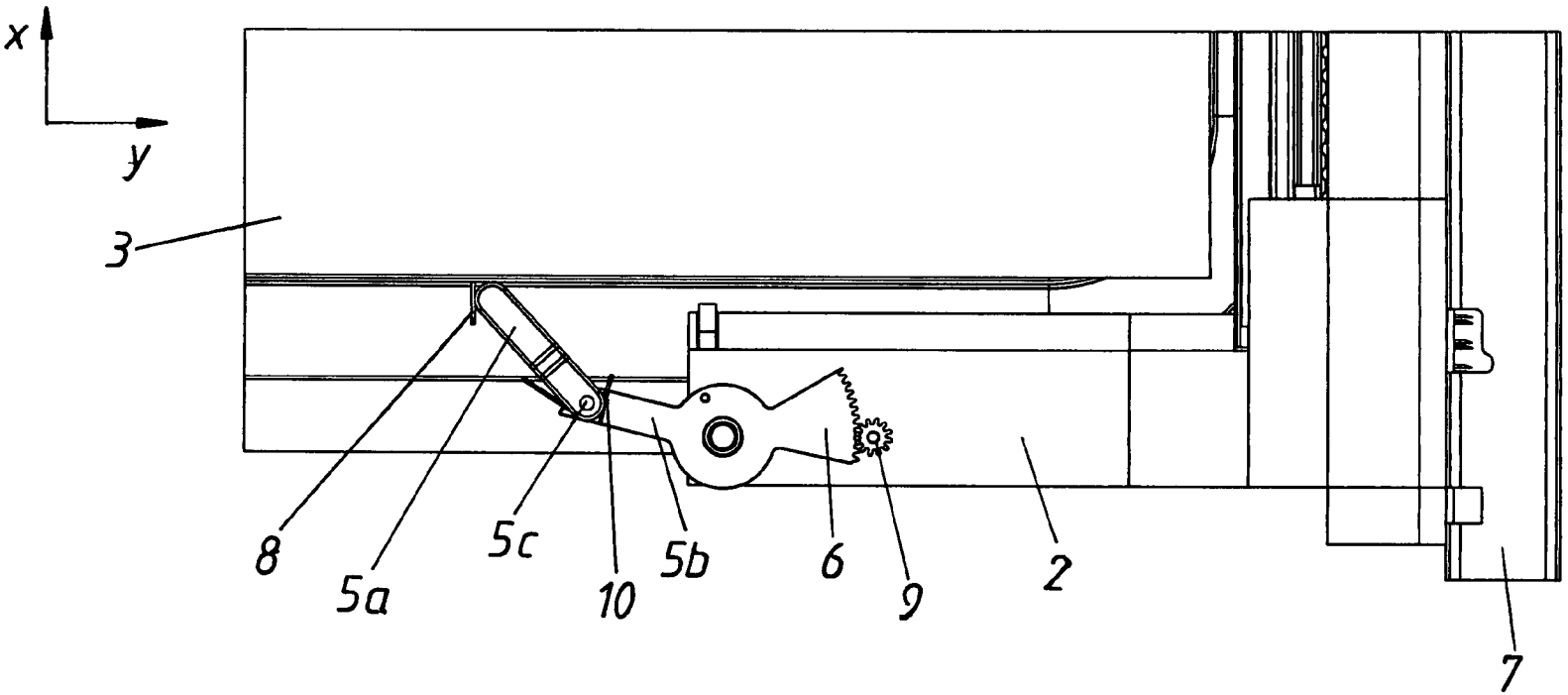

FIG. 2 shows three views illustrating a first embodiment of the invention with an actuating member 4 in the form of an articulated lever. The rear side of the furniture carcass 7 has been removed to allow a view of the trigger sensor 1. The actuating member 4 has two articulated arms 5*a*, 5*b* which are hingedly connected (linked) together by way of a non-statutory rotary joint 5*c* to form an articulated lever having a base end and a distal end, with the joint 5*c* located between the base end and the distal end. The first articulated arm 5*a* cooperates with an abutment 8 arranged on the furniture part 3, and the second articulated arm 5*b* is in one piece with (integrally connected to) an output drive 6 rotatably attached to furniture drive 2. The output drive 6 cooperates with a potentiometer (not shown in greater detail) by way of a drive wheel 9. The trigger sensor 1 is here arranged directly on the furniture drive 2. As illustrated in FIGS. 2*b* and 2*c*, the base end of the articulated lever is the end of second arm 5*b* rotatably mounted to the furniture drive 2, and the distal end of the articulated lever rests against abutment 8.

Basically two trigger functionalities can be provided. In the one trigger functionality, the potentiometer already triggers the furniture drive 2 when the drive wheel 9 begins to move. With the other trigger functionality, the potentiometer must first receive a predetermined number of revolutions of the drive wheel 9 before triggering of the furniture drive 2 is effected. In that case, therefore, triggering occurs only after a given distance has been covered.

As can be seen in particular from FIGS. 2*b* and 2*c*, the two articulated levers 5*a*, 5*b* are acted upon relative to each other by a spring 10. That arrangement provides that the articulated lever 5*a* is biased in relation to the articulated lever 5*b* in an articulation position, more specifically in such a way that, without an external force acting thereon, it assumes the position shown in FIG. 2*c*.

That prestressing effect provides that the actuating member 4 is moved, on the one hand, upon a pure movement of the furniture part 3 in the x-direction. On the other hand, it provides that a movement of the furniture part 3 in the y-direction also causes a movement of the actuating member 4, which improves the triggering sensitivity of the trigger sensor 1 according to the invention in comparison with the state of the art. Therefore triggering of the furniture drive 2 can be implemented by both movements.

Figure 6A:
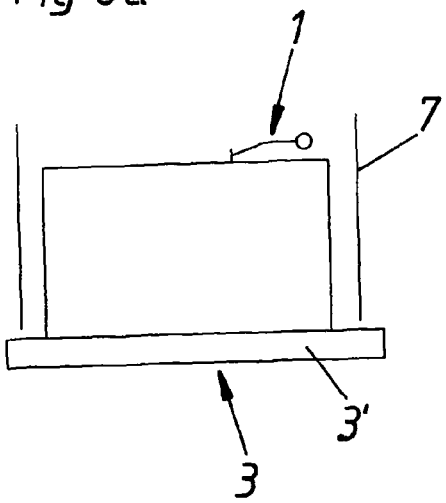
FIGS. 6*a* through 6*e* show various trigger situations.
Figure 6B:
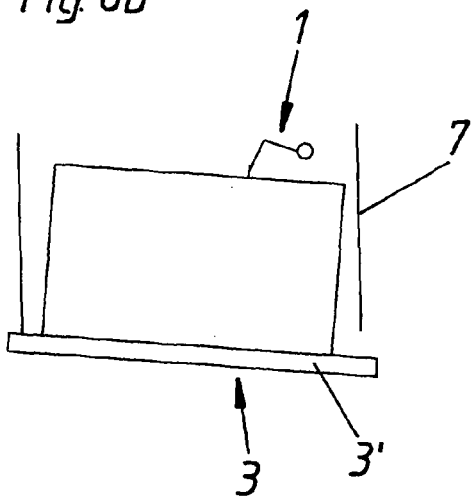
Figure 6C:
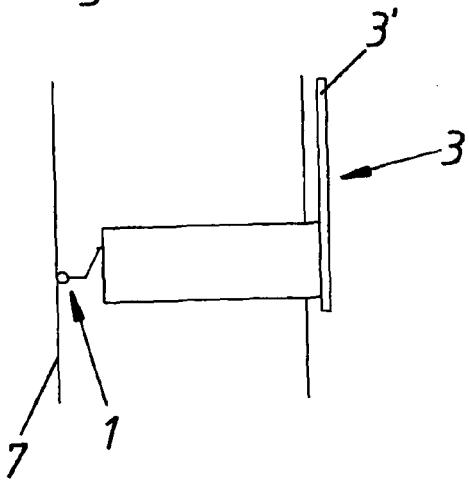
Figure 6D:
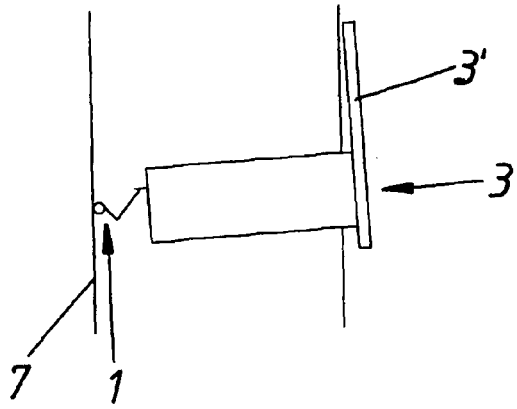
Figure 6E:
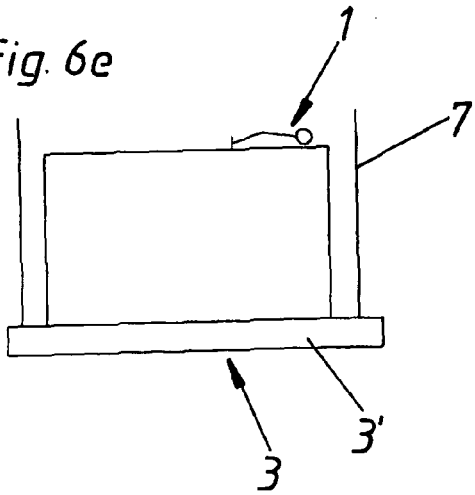

In FIG. 2*b*, the furniture part 3 is in its fully closed end position. Even in the fully closed end position there still remains a push-in travel for the furniture part 3, which can be ensured in a per se known manner by spring buffers (not shown). In FIG. 2*c*, in comparison with FIG. 2*b*, the furniture part 3 has been laterally pushed in by hand by a user (for example as shown in FIG. 6*b*). The resulting movement of the actuating member 4 which is transmitted by way of the output drive 6 to the drive wheel 9 of the potentiometer is registered by the trigger sensor 1 and fed to the furniture drive 2 for triggering thereof.

The illustrated configuration of the actuating member 4 provides that triggering of the furniture drive 1 can be registered not only upon a movement in the x-direction but also upon a movement in the y-direction (see FIG. 6).

Figure 3A:
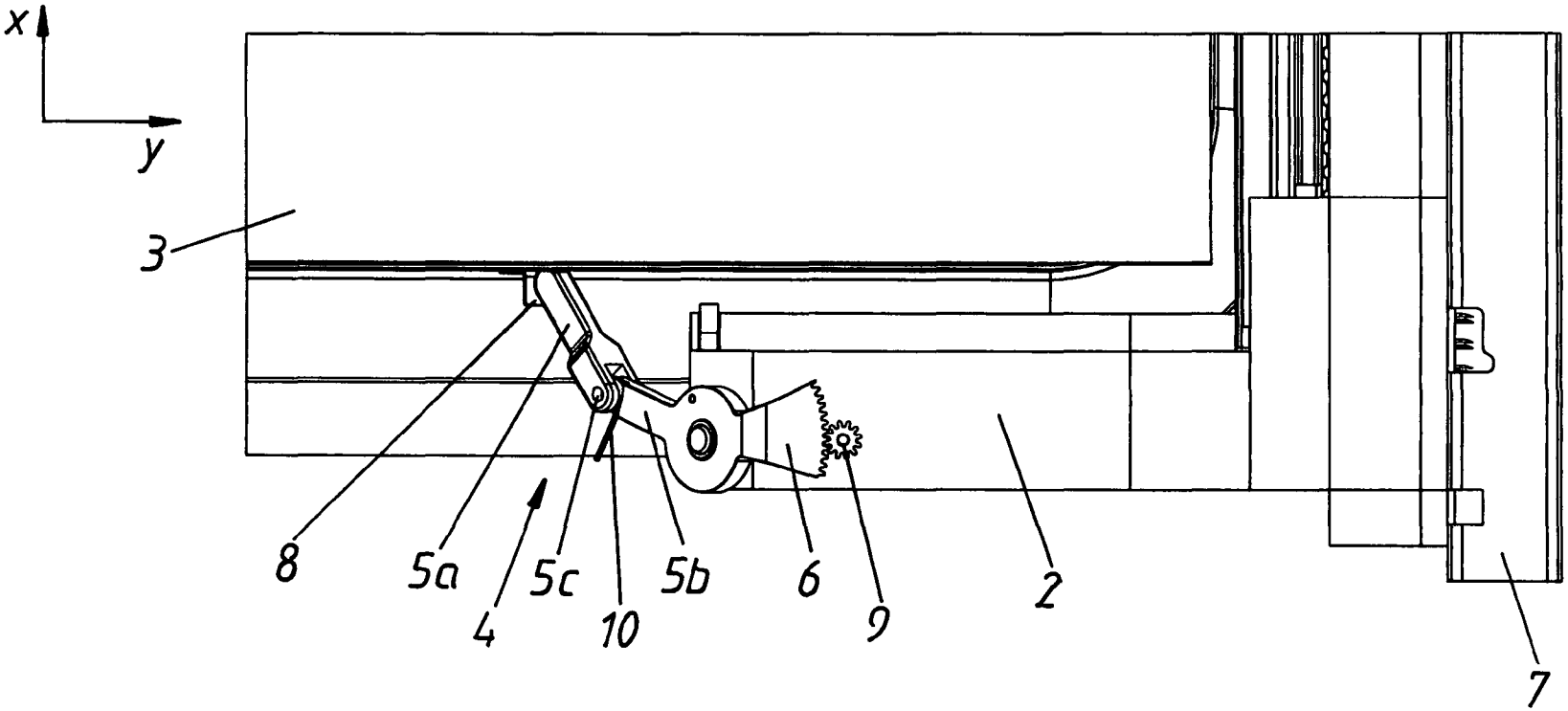
FIGS. 3*a*, 3*b*, 3*c* show a second embodiment of a trigger sensor according to the invention.
Figure 3B:
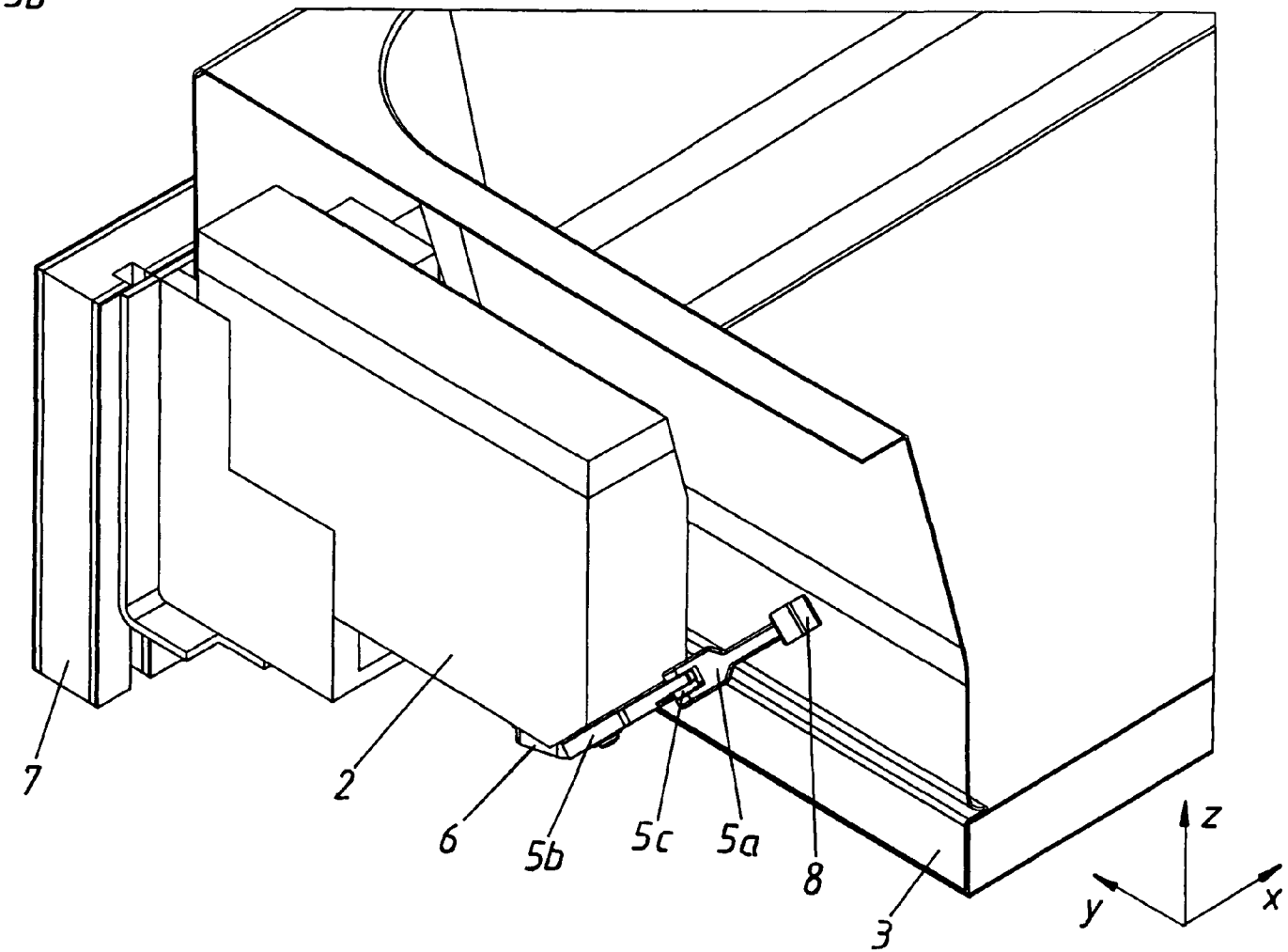
Figure 3C:
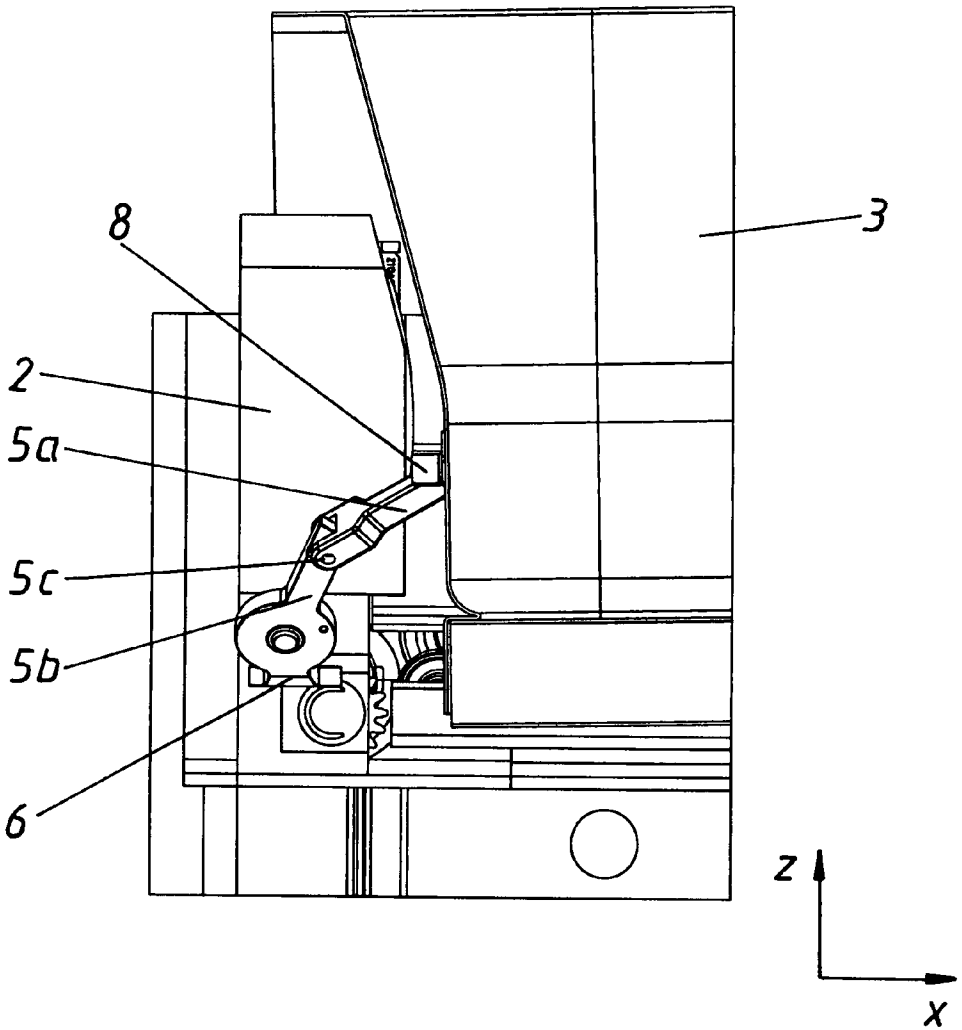

The embodiment of the invention shown in FIG. 3 differs from that in FIG. 2 in that the actuating member 4 is installed at an incline in the furniture carcass 7, that is to say it extends not only in the x- and y-direction but also in the z-direction. That configuration means that movements of the furniture part 3, which have a component in the z-direction, can also be detected. As can be seen in particular from FIG. 3*b* the output drive 6 for the drive wheel 9 of the potentiometer has a bent configuration for that purpose.

Unlike the situation shown in the Figures, a trigger sensor 1 according to the invention can also be arranged separately from the furniture drive 2 on the furniture carcass 7 or on the furniture part 3 and can be in a signal-transmitting relationship therewith. It is also possible to provide two or more furniture drives 2 for driving the same furniture part 3. The trigger sensor 1 and the abutment 8 can also be arranged laterally on the furniture carcass 7 or on the movable furniture part 3 respectively. The furniture drive 2 can have, for example, a conventional electric motor and can be designed for example precisely as in one of FIG. 3*a*, 4*a* or 5*a* of WO 2006/113947 A1. Other configurations for the furniture drive 2, for example being constantly connected to the furniture carcass 7 and the furniture part 3 (see for example EP 1 374 732 A1) are also conceivable.

Driving of a furniture part 3 by a furniture drive 2 according to the invention can be limited to the furniture part 3 being moved out of the closed end position in or on the furniture carcass 7 only to such an extent that a user can engage the furniture part 3 by hand and can manually move it further (initial push aid).

Figure 4:
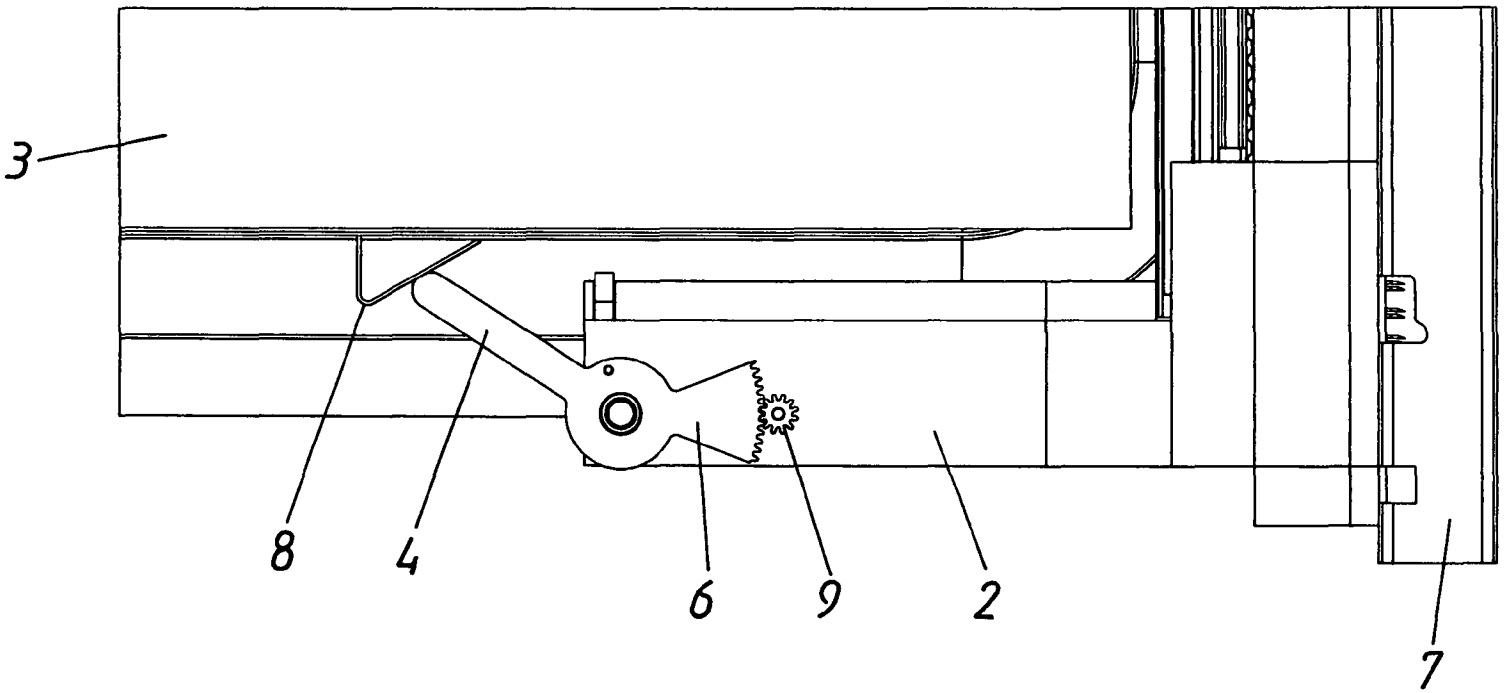
FIG. 4 shows a trigger sensor cooperating with an inclined plane.
Figure 5:
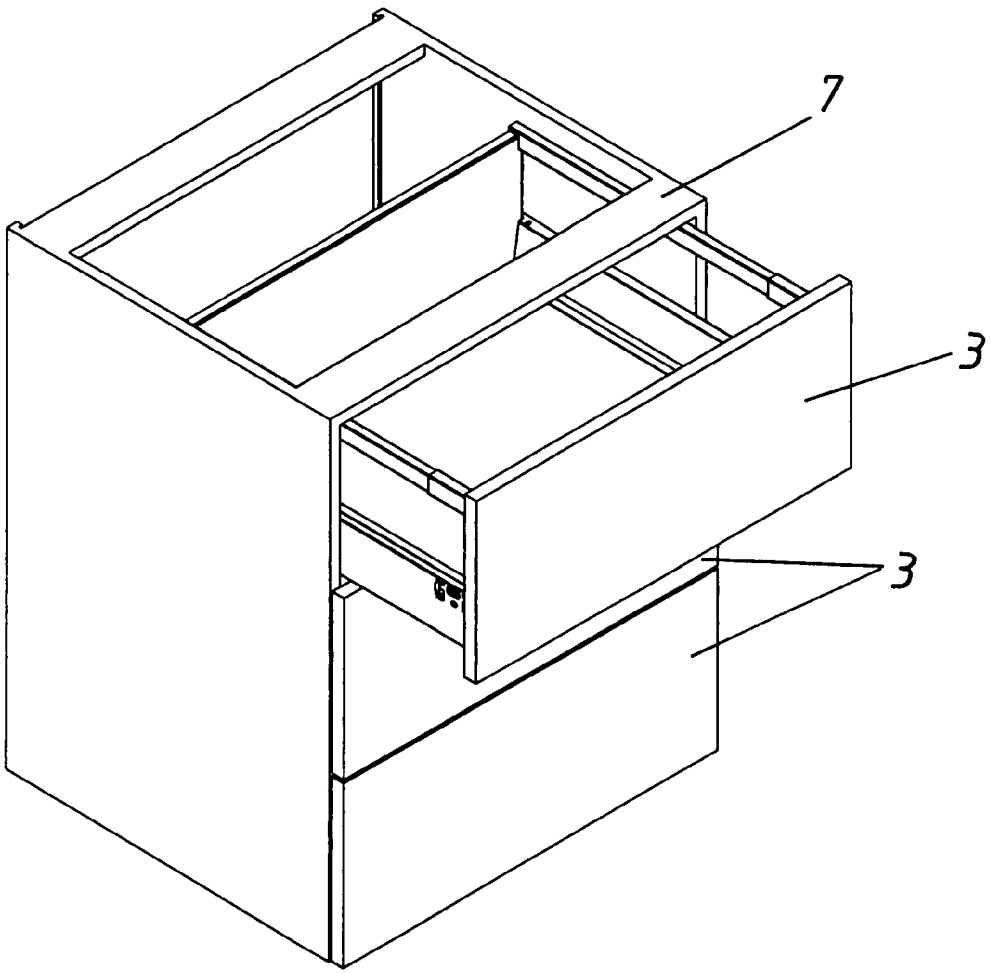
FIG. 5 shows an overall view of an article of furniture with a trigger sensor according to the invention.

FIG. 4 shows a trigger sensor 1 cooperating with an abutment 8 which is in the form of an inclined plane and which here is arranged on the furniture part 3 and oriented at an angle with respect to output drive 6. The actuating member 4 of the trigger sensor 1 is here in one piece. The sensitivity of the trigger sensor 1 that is required according to the invention, along at least two directions x, y, z which are orthogonal to each other, is achieved here solely by the part of the inclined plane which extends at an incline (having components in the x- and y-directions).

Lines for the electric power supply and signal transmission have not been shown.

Quite generally, it can be said that the trigger sensor 1 according to the invention reacts sensitively in relation to at least two mutually orthogonal directions of movement x, y, z of the furniture part 3.

The invention claimed is:

1. A trigger sensor for triggering an electric furniture drive based on a movement of a furniture part to be driven by the furniture drive, said trigger sensor comprising:

an actuating member comprising an articulated lever having a base end and a distal end, said articulated lever including two articulated arms linked together and movable relative to each other by a rotary joint located between said base end and said distal end; and a spring arranged to act on said two articulated arms relative to each other;

wherein said actuating member is to be arranged between the furniture drive and the furniture part so that movements of the furniture part in at least two directions orthogonal to each other are detectable by said trigger sensor.

2. The trigger sensor of claim 1, further comprising an output drive arranged on one of said two articulated arms for allowing said actuating member to cooperate with a potentiometer.

3. The trigger sensor of claim 2, wherein said output drive extends at an angle with respect to a longitudinal axis of said one of said two articulated arms on which said output drive is arranged.

4. The trigger sensor of claim 1, wherein said rotary joint is non-stationary.

5. The trigger sensor of claim 1, wherein said base end of said articulated lever is to be rotatably mounted to one of the furniture drive, a furniture carcass, or the furniture part.

6. The trigger sensor of claim 5, wherein said rotary joint is non-stationary.

7. An arrangement comprising:

an electric furniture drive for driving a furniture part; and a trigger sensor for triggering said furniture drive based on a movement of the furniture part to be driven by said furniture drive, said trigger sensor including:

an actuating member comprising an articulated lever having a base end and a distal end, said articulated lever including two articulated arms linked together and movable relative to each other by a rotary joint located between said base end and said distal end; and a spring arranged to act on said two articulated arms relative to each other;

wherein said actuating member is to be arranged between said furniture drive and the furniture part so that movements of the furniture part in at least two directions orthogonal to each other are detectable by said trigger sensor.

8. The arrangement of claim 7, wherein said trigger sensor further includes an output drive arranged on one of said two articulated arms for allowing said actuating member to cooperate with a potentiometer.

9. The arrangement of claim 8, wherein said output drive extends at an angle with respect to a longitudinal axis of said one of said two articulated arms on which said output drive is arranged.

10. The arrangement of claim 7, wherein said rotary joint is non-stationary.

11. The arrangement of claim 7, wherein said base end of said articulated lever is to be rotatably mounted to one of said furniture drive, a furniture carcass, or the furniture part.

12. The arrangement of claim 11, wherein said rotary joint is non-stationary.

13. An article of furniture comprising:

a furniture carcass;

a furniture part mounted movably relative to said furniture carcass; and said arrangement of claim 7;

wherein said furniture drive is triggerable by a movement of said furniture part movable in at least two directions orthogonal to each other.

14. The article of furniture of claim 13, wherein an axis of rotation of said rotary joint of said articulated lever extends orthogonally with respect to a direction of movement of said furniture part.

15. The article of furniture of claim 13, wherein an axis of rotation of said rotary joint of said articulated lever extends at a non-90° angle with respect to a direction of movement of said furniture part.

16. The article of furniture of claim 13, wherein said trigger sensor of said arrangement further includes an abutment on said furniture part, said abutment engaging with a distal end of said articulated lever.

17. A trigger sensor for triggering an electric furniture drive based on a movement of a furniture part to be driven by the furniture drive, said trigger sensor comprising:

an actuating member comprising a lever; and an output drive fixed to said lever such that said output drive extends at an angle with respect to said lever, said output drive being configured to allow said actuating member to cooperate with a potentiometer;

wherein said actuating member is to be arranged between the furniture drive and the furniture part so that movements of the furniture part in at least two directions orthogonal to each other are detectable by said trigger sensor.

18. An arrangement comprising:

an electric furniture drive for driving a furniture part; and a trigger sensor for triggering said furniture drive based on a movement of the furniture part, said trigger sensor including:

an actuating member comprising a lever; and an output drive fixed to said lever such that said output drive extends at an angle with respect to said lever, said output drive being configured to allow said actuating member to cooperate with a potentiometer;

wherein said actuating member is to be arranged between said furniture drive and the furniture part so that movements of the furniture part in at least two directions orthogonal to each other are detectable by said trigger sensor.

19. An article of furniture comprising:

a furniture carcass;

a furniture part mounted movably relative to said furniture carcass; and said arrangement of claim 18;

wherein said furniture drive is triggerable by a movement of said furniture part movable in at least two directions orthogonal to each other.

20. The article of furniture of claim 19, wherein said trigger sensor of said arrangement further includes an abutment on said furniture part, said abutment engaging with said lever.

21. The article of furniture of claim 20, wherein said abutment is formed as an inclined plane.

* * * * *

UNITED STATES PATENT AND TRADEMARK OFFICE
Certificate

Patent No. 8,246,128 B2 Patented: August 21, 2012

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Christian Hauer, Hörbranz (AT); and Violand Wilfried, Gaiβau (AT).

Signed and Sealed this Twelfth Day of August 2014.

DARNELL JAYNE
*Supervisory Patent Examiner*
Art Unit 3637
Technology Center 3600